US006622795B2

(12) United States Patent
Hebert et al.

(10) Patent No.: US 6,622,795 B2
(45) Date of Patent: Sep. 23, 2003

(54) FLOW ACTUATED VALVE FOR USE IN A WELLBORE

(75) Inventors: John E. Hebert, Houma, LA (US); Joseph J. Boudreaux, Houma, LA (US); David F. Laurel, Cypress, TX (US); Scott A. Darby, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/995,842

(22) Filed: Nov. 28, 2001

(65) Prior Publication Data

US 2003/0098163 A1 May 29, 2003

(51) Int. Cl.[7] ..... E21B 34/00

(52) U.S. Cl. ..... 166/374; 166/325; 166/326; 137/515.7

(58) Field of Search ..... 137/515.7; 166/374, 166/386, 325, 326, 327, 332.2

(56) References Cited

U.S. PATENT DOCUMENTS 2,724,443 A 11/1955 Baker ..... 166/225
2,791,279 A * 5/1957 Clark, Jr. ..... 166/327
3,032,050 A 5/1962 Clark, Jr. ..... 137/68
3,385,370 A * 5/1968 Knox et al. ..... 166/327
3,776,250 A 12/1973 Knox
4,683,955 A * 8/1987 Stepp et al. ..... 166/327
5,320,181 A 6/1994 Lantier, Sr. et al.
5,411,049 A 5/1995 Colvard ..... 137/71

OTHER PUBLICATIONS

PCT International Search Report, International Application No. PCT/GB 02/05404, dated Feb. 21, 2003.

* cited by examiner

*Primary Examiner*—William Neuder
(74) *Attorney, Agent, or Firm*—Moser, Patterson & Sheridan, L.L.P.

(57) ABSTRACT

The present invention generally relates to a flow-actuated valve for use in a wellbore. The invention includes a body having a closing member and a seat. The closing member and seat are separable to open and close the valve, thereby allowing the flow of fluid through the valve. The invention further includes a retainer to initially retain the valve in the open position absent a predetermined fluid flow rate in a first direction for a predetermined time period. A biasing member thereafter urges the valve to the closed position, absent another fluid flow rate in the first direction.

13 Claims, 9 Drawing Sheets

FLOW ACTUATED VALVE FOR USE IN A WELLBORE

BACKGROUND OF THE INVENTION

1. Field of the Invention

The present invention relates to a flow actuated valve for use in a wellbore. More particularly, the invention relates to a flow-actuated valve that is initially retained in an open position and is closeable with the application of fluid flow. More particularly still, the invention relates to a flow-actuated valve for use in float equipment to facilitate the injection of zonal isolation fluids into an annular area between a string of casing and a surrounding formation.

2. Description of the Related Art

Hydrocarbon wells are conventionally formed one section at a time. Typically, a first section of wellbore is drilled in the earth to a predetermined depth. Thereafter, that section is lined with a tubular string, or casing, to prevent cave-in. After the first section of the well is completed, another section of well is drilled and subsequently lined with its own string of tubulars, comprised of casing or liners. Each time a section of wellbore is completed and a section of tubulars is installed in the wellbore, the tubular is typically anchored into the wellbore through the use of wellbore zonal isolation fluids, i.e. cementing. Wellbore zonal isolation fluids includes, but not limited to, the injection of cement into an annular area formed between the exterior of the tubular string and the borehole in the earth therearound. Zonal isolation protects the integrity of the wellbore and is especially useful to prevent migration of hydrocarbons towards the surface of the well via the annulus.

Zonal Isolation of strings of tubulars in a wellbore is well-known in the art. Typically, the zonal isolation fluid is initially inserted in the tubular, and then forced to the bottom of the well and up the annular area toward the surface. With the use of other fluids, a column of zonal isolation fluids can be forced down the tubular string and into the annulus, resulting in a completely isolated annulus and leaving only a small amount of zonal isolation fluid at the bottom of the borehole. The cured fluid is drillable and is easily destroyed by subsequent drilling to form the next section of wellbore.

Float shoes and float collars facilitate zonal isolation procedures. In this specification, a float shoe is a valve-containing apparatus disposed at or near the lower end of the tubular string that is run into in a wellbore. A float collar is a valve-containing apparatus which is installed at some predetermined location, typically above a shoe within the tubular string. In certain cases, float collars are required rather than float shoes. However, in this specification, the term float shoe and float collar will be used interchangeably.

The main purpose of a float shoe is to facilitate the passage of zonal isolation fluids from the tubular to the annulus of the well while preventing the zonal isolation fluids from returning or "u-tubing" back into the tubular due to gravity and fluid density of the liquid zonal isolation fluids. In its most basic form, the float shoe includes a one way valve permitting fluid to flow in one direction through the valve, but preventing fluid from flowing back into the tubular from the opposite direction. The float shoes usually include a cone-shaped body to prevent binding of the tubular string during run-in.

As mentioned, wellbores are typically full of fluid to protect the drilled formation of the borehole and aid in carrying out cuttings created by a drill bit. When a new string of tubulars is inserted into the wellbore the tubulars must necessarily be filled with fluid to avoid buoyancy and equalize pressures between the inside and the outside of the tubular. For these reasons, a float shoe can be capable to temporarily permit fluid to flow inwards from the well bore as the tubular string is run into the wellbore and fills the tubular string with fluid. In one simple example, a spring loaded, normally closed, one-way valve in a float shoe is temporarily propped in an open position during run-in of the tubular by a wooden object which is thereafter destroyed and no longer affects the operation of the valve.

Other, more sophisticated solutions have been used that temporarily hold the valve in an open position and subsequently permit it to close and operate as a normally closed, one way valve. In a prior art arrangement, a valve is temporarily held in an open position during run-in and, thereafter, a weighted ball is dropped from the surface. The ball sinks to a seated position within the valve of a float collar and then, with pressure applied from the surface of the well, the valve is then enabled to shift to its normally closed position. In another prior art solution, a spring-loaded plunger is moved from an open position to a closed position utilizing hydrostatic pressure. The design utilizes an atmospheric chamber and shears screws. The number of shear screws determines the trip point of the device. As the tubular string is run deeper into a wellbore, hydrostatic pressure builds until it generates sufficient force on the shear screws to cause them to fail. The shearing action releases the plunger converting the valve to a normally closed, one-way valve.

More recently, spring loaded plunger valves in float shoes have been moved from a retained open position with the flow of fluid. The existing designs use energy from wellbore fluid that is circulated with pumps through the valve to depress the plunger and subsequently trip the device. These devices are typically comprised of some form of stop which temporarily retains the valve in an open position. Typically, wedges, tabs, balls, or knobs are mechanically lodged between the plunger and its retainer. These hold the plunger open against the spring force. When sufficient flow is established, the plunger moves downward, compressing the spring further and releasing the wedged stops.

There are problems associated with the prior art devices. Particularly, these devices are susceptible to premature release of the mechanism retaining the valve in an open position. For example, devices requiring a burst of fluid flow for de-activation can sometimes operate prematurely due to naturally occurring flow increases. Devices using an atmospheric chamber sometimes fail to operate as designed due to either design flaws or changes in well bore fluid density. If the valve releases premature, it is no longer possible to fill the tubular string with fluid from below. Because the tubular string must necessarily be filled with fluid to prevent pressure collapse and buoyancy, fluid must then be introduced from the surface of the well, thereby increasing the already high cost of completing drilled sections of wells.

SUMMARY OF THE INVENTION

The present invention generally relates to a flow-actuated valve for use in a wellbore. The invention includes a body having a closing member and a seat. The closing member and seat are separable to open and close the valve, thereby allowing the flow of fluid through the valve. The invention further includes a retainer to initially retain the valve in the open position absent a predetermined fluid flow rate in one direction for a predetermined time period. A biasing member thereafter urges the valve to the closed position, absent another fluid flow rate in one direction.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
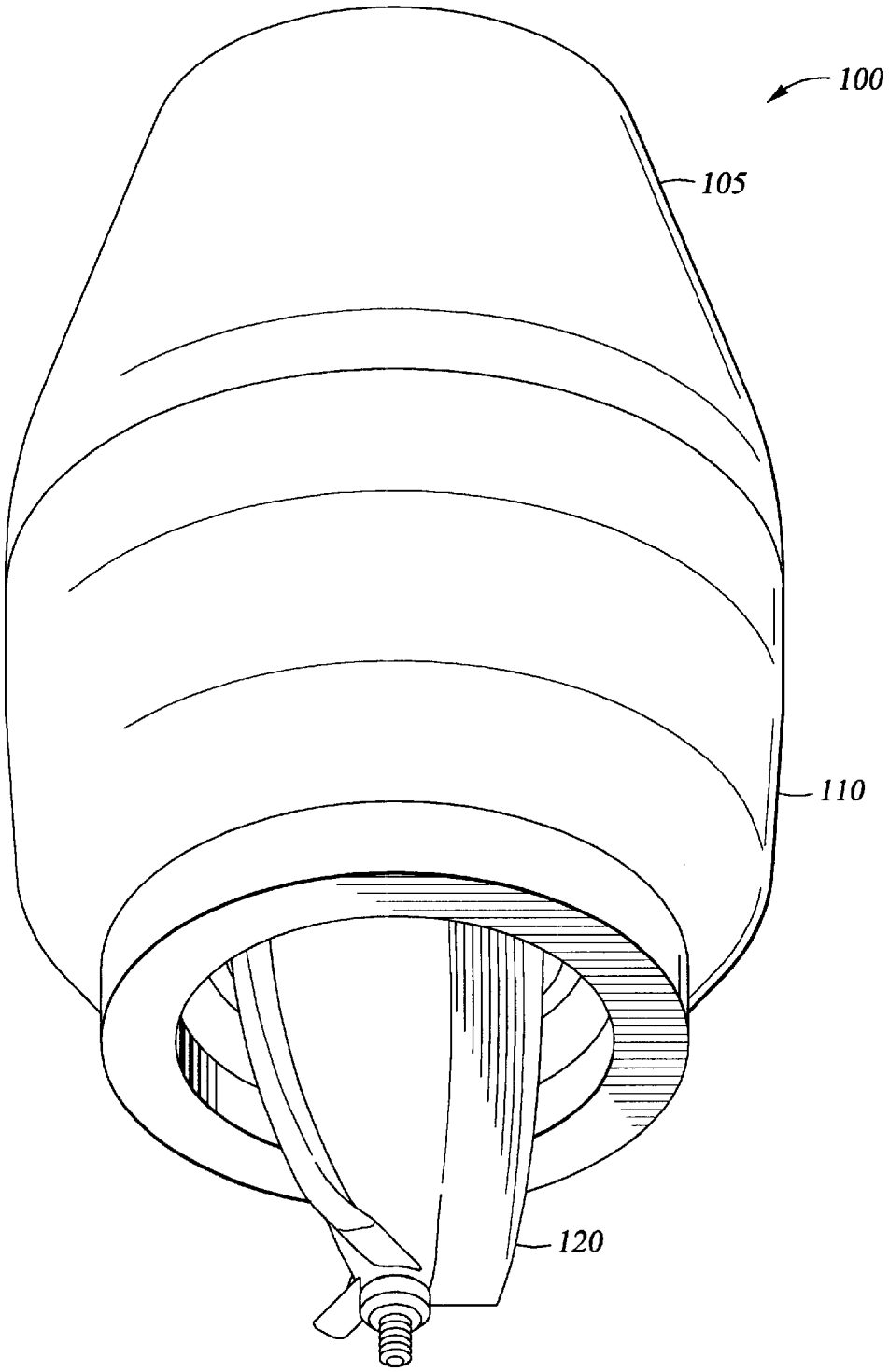
FIG. 1 is a perspective view of a valve of the present invention.

FIG. 1 is a perspective view of a valve 100 of the present invention. Visible in FIG. 1 is an upper housing 105 and a lower 110 housing. Also visible is an impeller 120 partially extending from the lower housing 110. In use, the valve 100 is disposed in the interior of a tubular string (not shown) in a manner whereby all fluid passing through the tubular in either direction must flow through the valve 100. In one example, the valve 100 is disposed at a lower end of a tubular string. In another example, the valve 100 is disposed at some location within the tubular apparatus, such as in a collar within a string of casing.

Figure 2:
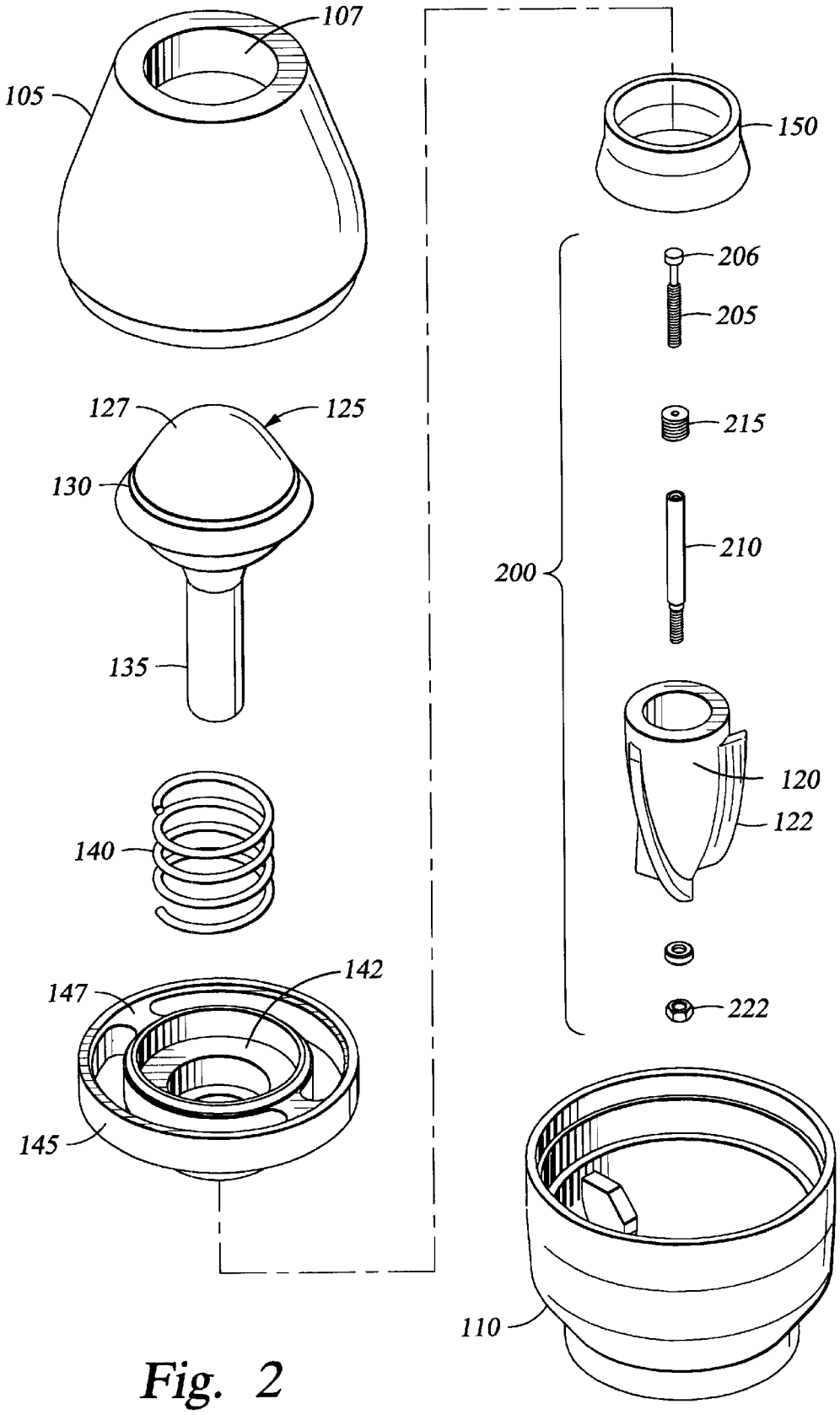
FIG. 2 is an exploded view of the valve of FIG. 1.

FIG. 2 is an exploded view of the valve 100 of FIG. 1. Visible in FIG. 2 are the upper 105 and lower 110 housings. The upper housing 105 includes an aperture 107 formed therethrough with a seat (not visible) formed in an interior surface thereof. Additional components of the valve 100 are substantially housed between the upper 105 and lower 110 housings. A plunger 125 with a head portion 127 and a sealing member 130 therearound creates a sealing relationship between the plunger 125 and the valve body 105 when the valve 100 is closed. The sealing member, therefore blocks the inward flow of fluid of valve 100 as fluids attempt to enter the tubular string. The plunger 125 includes a shaft 135. A biasing member, in this case a spring 140, is locatable between the head 127 of the plunger 125 and a surface 142 formed in a support member 145. The spring 140 is constructed and arranged to become compressed as the head 127 of the plunger moves away from the upper housing 105. In this manner, valve 100 is biased in a closed position. The support member 145 also includes a fluid path therethrough with radially disposed spokes 147 extending between an inner and an outer portion. Below the support member 145 is an annular diverter 150 for diverting the flow of fluid through the valve as is illustrated in FIGS. 3–7.

The valve of the present invention also includes a retention assembly 200. The retention assembly 200 serves to temporarily hold the valve 100 in an open position. The open position is especially useful to permit a tubular string to fill with fluid during run-in into a wellbore. The retention assembly 200 operates by holding the plunger head 127 away from the seat in the upper housing 105 until a sustained fluid flow rate is applied through the valve 100 in a forward direction. Typically, the forward direction is a downward direction. A partially threaded bolt 205 having a head 206 at an upper end is insertable into a hollow portion of the shaft 135 of the plunger 125. A sleeve 210 is attachable to the bolt 205 and is extendable through a body of an impeller 120, where it is retained at a bottom end thereof with a fastener 222. The impeller 120, as will be described, include blades 122 formed on a body thereof to urge the impeller 120 to rotate as the blades are acted upon by a fluid flow. The bolt 205 and the upper portion of sleeve 210 are held within the plunger shaft by a bushing 215 having threads on an inner and outer diameter. The release assembly 200 is designed whereby the bolt and sleeve will rotate with the impeller 120 while the bushing 215 and the plunger 125 will remain rotationally fixed. In this manner, axial movement of the impeller and bolt is transmitted by the interaction of the threads of the bolt 205 and the bushing 215.

Figure 3:
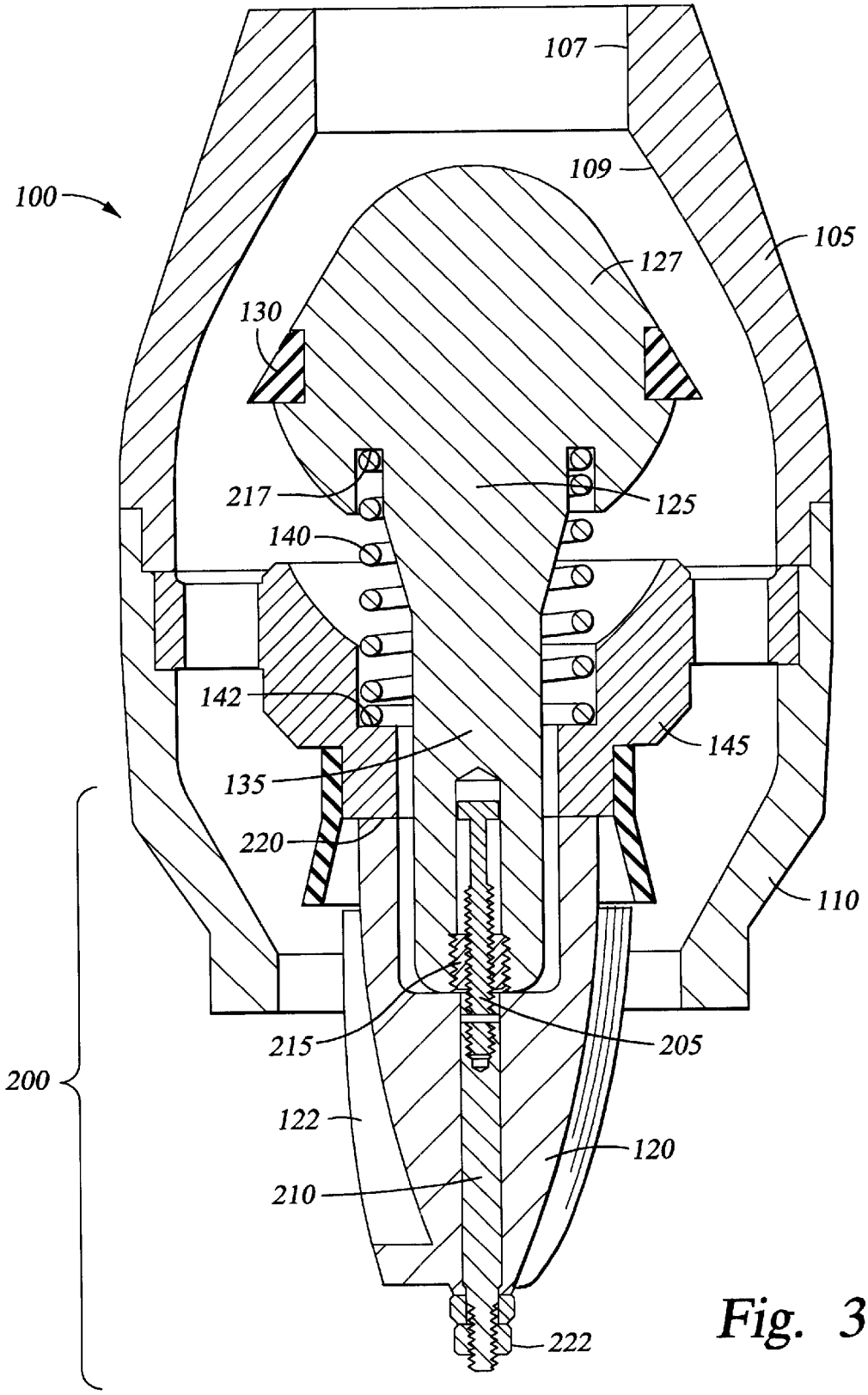
FIG. 3 is a section view of the valve of FIG. 1, with a retention assembly retaining the valve in an open position.

FIG. 3 is a section view of the valve 100 with the retention assembly 200 retaining the valve in an open position. Visible in the figure is an aperture 107 in an upper end of upper housing 105. In the interior of the housing 105 is seat 109 providing a sealing surface for the sealing member 130 of the plunger 125. In the retained position, the spring 140 is compressed between an annular surface 217 formed on the underside of the plunger head 127 and annular surface 142 of support member 145. The retention assembly 200 operates to hold plunger 125 in the position of FIG. 3 through a mechanical connection between bushing 215 and bolt 205. As illustrated, the bushing 215 is held in the lower end of the shaft 135 of plunger 125 while the bolt 205 is held within the sleeve 210. The threaded connection between the bushing 215 and the bolt 205 determines the relative position of the plunger head 127 with respect to the seat 109.

Impeller 120 with blades 122 is retained between an underside 220 of support member 145 and fastener 222 threaded to a lower end of the sleeve 210. The purpose of the impeller 120 is to rotate in one of two directions depending upon the flow force of fluid past its blades 122. Because the bolt 205 moves with the impeller 120, rotation of the impeller 120 in either direction will cause relative axial movement between the bolt 205 and the bushing 215.

Figure 4:
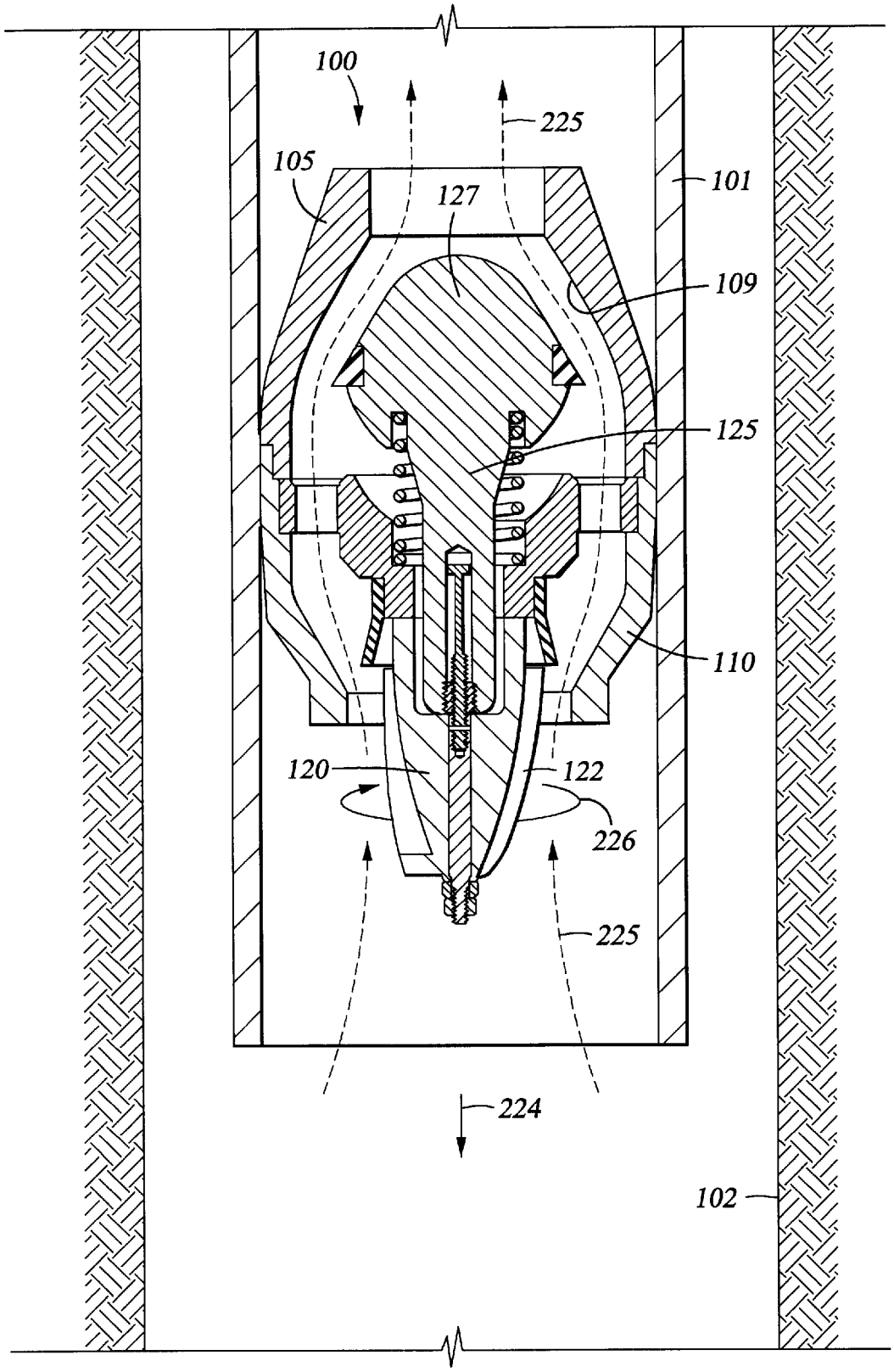
FIG. 4 is a section view of a wellbore with a valve of the present invention disposed in a tubular.

FIG. 4 is a section view of the valve 100 illustrating the flow of fluid through the valve 100 in direction 225. As previously described, the valve 100 is typically disposed in the bottom end of the tubular string 101 which is then run into a wellbore 102 having drilling fluid therein. One purpose of the valve 100 is to initially permit fluid to pass from a lower to an upper portion of the valve 100 as the tubular string 101 is being lowered into the wellbore 102. Arrow 224 illustrates the movement of the tubular string 101 in relation to the wellbore 102. Thereafter, the retention assembly 200 of the valve 100 is deactivated, and the valve 100 operates as a normally closed, one-way valve permitting fluid to pass from an upper to a lower portion.

In FIG. 4, the valve 100 is illustrated in a run-in position with the retention assembly 200 activated. As illustrated, the head 127 of plunger 125 is separated from seat 109 formed in the upper housing 105 of the valve 100. As illustrated with arrows 225, fluid flows from a lower end of the valve 100 through an annular area formed in the valve 100 between the plunger 125 and the upper 105 and lower 110 housing portions. Also illustrated by separate arrow 226 is a rotational force applied to the impeller 120 by fluid moving past blades 122 of impeller 120. In the illustration of FIG. 4, the fluid flow in direction 225 acts on the impeller blades 122 urging the impeller 120 to rotate in a clockwise direction. However, due to high frictional forces, rotation is prohibited.

Figure 5:
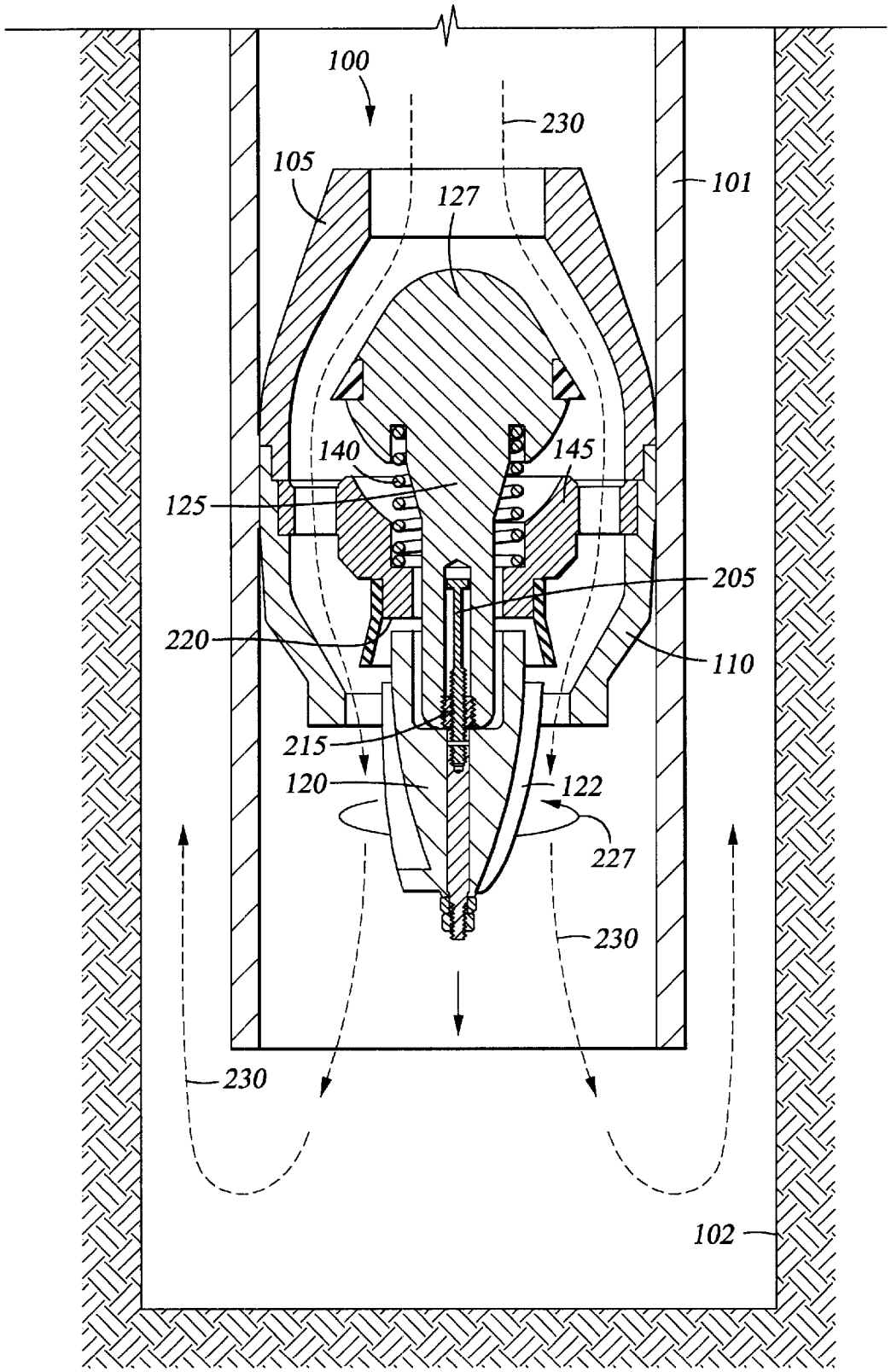
FIG. 5 is a section view of the valve of FIG. 4 as the retention assembly is being deactivated.

FIG. 5 is a section view of the valve 100. In FIG. 5, the retention assembly 200 is being deactivated and the flow of fluid through the valve 100 is illustrated by arrows 230. The arrows 230 illustrate fluid being pumped from an upper end of the valve 100 through an annular area defined between the outer surface of the plunger 125 and the inner surface of the upper 105 and lower 110 housings. In FIG. 5, the flow of fluid acting on the upper surface of plunger head 127 has depressed the plunger 125 and compressed the spring 140 further than it was originally compressed during run-in. The additional compression of the spring 140 and downward movement of plunger 125 has caused a corresponding downward axial movement of the impeller 120. An under side 220 of support member 145 is shown separated from the upper surface of the impeller 120. The result of this separation is greater freedom of the impeller 120 to rotate as the fluid moves across its blades 122. Of course, the scope of the present invention permits a design of the valve 100 which does require the separation of the support member 145 from the impeller 120 before rotation of the impeller 120.

In order to initiate the release of the retention assembly 200 of FIG. 5, two conditions are created simultaneously. First, the plunger 125 is depressed past its originally retained position in order to separate the impeller 120 from the lower surface 220 of support member 145, making it easier for the impeller to rotate. Second, the impeller 120 must be rotated by fluid passing across the from an upper to a lower portion of the valve 100. The rotation of the impeller 120 with the bolt 205, in direction 227, will cause the threaded portion of the bolt 205 to move downward in relation to the bushing 215. As the impeller 120 continues to rotate, that portion of the bolt 205 which is threaded will pass through the bushing, allowing the bolt 205 to then slide freely within the bushing 215 after its threads are disengaged therefrom.

Figure 6:
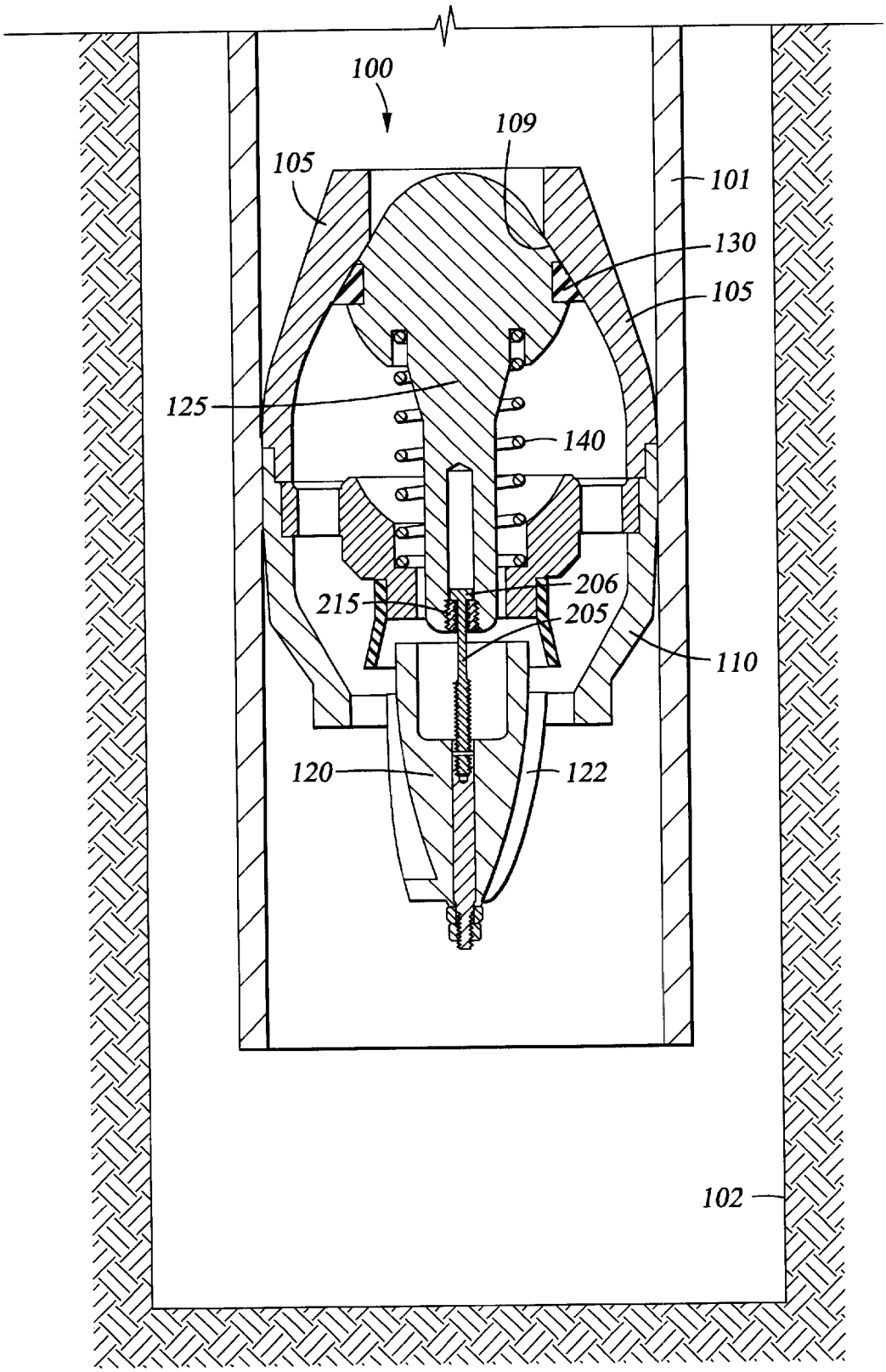
FIG. 6 is a section view of the valve operable as a one way, normally closed valve.

FIG. 6 is a section view of the valve 100 disposed in a tubular string 101 which is itself disposed in a wellbore 102. FIG. 6 illustrates the valve 100 with the retention assembly 200 deactivated. As illustrated, bushing 215 is adjacent a portion of the bolt 205 having no threads on its outer diameter. Bolt 205 has slipped through the bushing to a location whereby head 206 of the bolt is retained on an upper surface of the bushing 215. The axial movement of the bolt 205 with respect to bushing 215 has permitted the plunger 125 with its sealing member 130 to contact seat 109 formed in the underside of upper housing 105. In this manner, the valve 100 is sealed to the flow of fluid from below, and will only permit fluid entry from above if the fluid flow is adequate to overcome the bias of spring 140. The retention assembly 200 has thus been permanently disengaged and the valve 100 can now operate as a typical float shoe valve permitting zonal isolation fluids to flow through the valve 100 from the surface downhole, but preventing a back flow of the zonal isolation fluids into the tubular string 101.

Figure 7:
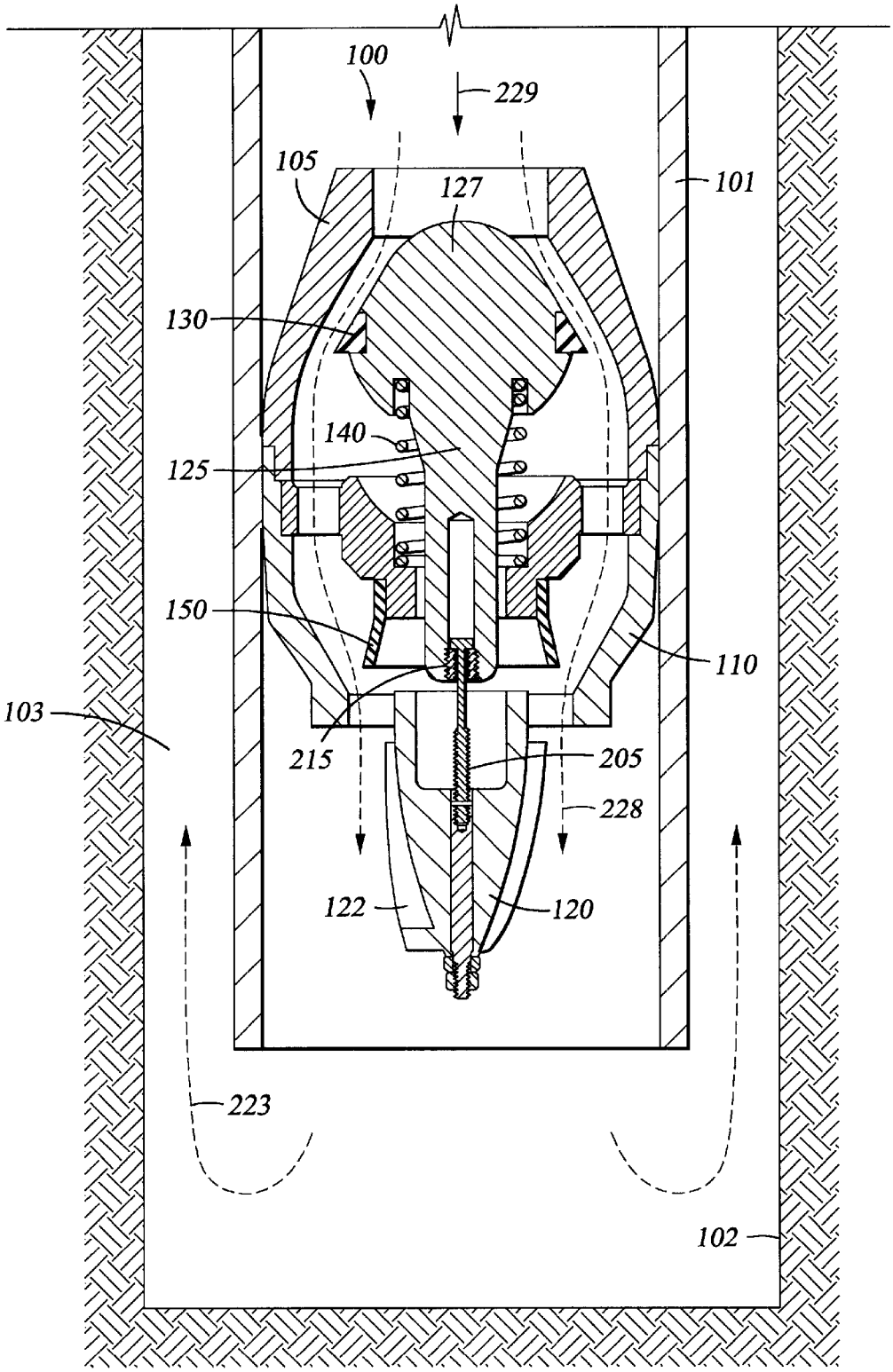
FIG. 7 is a section view of the valve operating to permit fluid to flow from its upper end to and through its lower end.

FIG. 7 is a section view of wellbore 102 with valve 100 in tubular string 101. FIG. 7 illustrates the valve 100 in use with zonal isolation fluids such as cement being pumped from an upper end of the tubular, through the valve 100, to the lower end of the wellbore 102. The movement of the plunger 125 downward is shown with arrow 229. The flow of fluid is illustrated with arrows 228. As illustrated by the arrows 228, zonal isolation fluids enters the valve 100 from an upper end and acts upon plunger head 127 to depress the plunger head 127 and to unseat sealing member 130 from seat 109 of upper housing 105. Spring 140 is shown in a somewhat compressed position. The fluid flows through the valve and the annular area created by the inside of the upper and lower housings 105, 110 and the outside of plunger 125. Thereafter, the fluid is guided around diverter 150 and exits through the lower end of the valve 100. Any effect the passing fluid may have on the blades 122 of the impeller 120 is unimportant as the impeller is free to rotate without creating any change in the valve 100. This is because the threads of the bolt 205 have now been released from the bushing 215. From the bottom of the tubular, the zonal isolation fluids flow upward to fill an annular area 103 formed between tubular 101 and wellbore 102. At some predetermined point, when the annulus 103 is filled with zonal isolation fluids, the flow of zonal isolation fluids is stopped and the fluids are allowed to cure. Thereafter, the cement shoe, including the valve 100 can be drilled up and destroyed by subsequent drilling of another section of wellbore.

In use, the valve 100 of the present invention is utilized as follows:

The valve 100 is disposed either at the end or near the end of a tubular 101, such as a casing or liner string. The tubular string 101 with the valve 100 disposed therein is run into a wellbore 102 with the retention assembly 200 of the valve holding it in an open position. In this manner, as the tubular string 101 is inserted into the wellbore 102, wellbore fluid is free to pass from a lower to an upper end of the valve 100, thereby permitting the tubular 101 to fill with fluid.

After the tubular string reaches a predetermined point in the well, wellbore fluid or some other fluid is pumped through the valve 100 at a predetermined flow rate 140. The injection of fluid under pressure further depresses the plunger head 127 and further compresses the biasing spring 140. In this manner, the impeller 120 disposed at the bottom of the valve 100 is separated from its contact with the surface of the support member 145 and is free to rotate. Simultaneously, the fluid utilized to depress the plunger urges the impeller 120 to rotate. The rotation of the impeller in direction 227 causes the threads of the bolt 205 and the bushing 215 to transmit motion of the bolt 205 in a downward direction with respect to the bushing 215. As that portion of the bolt 205 having threads pass through the bushing 215, a non-threaded portion of the bolt 205 permits the bolt 205 to drop to a lower position with respect to the bushing 215 and to be retained in the bushing 215 by bolt head 206. In this position, the retention assembly 200 is deactivated and the valve 100 operates as a normally closed, spring loaded, one-way valve for cementing operations in a wellbore.

Figure 8:
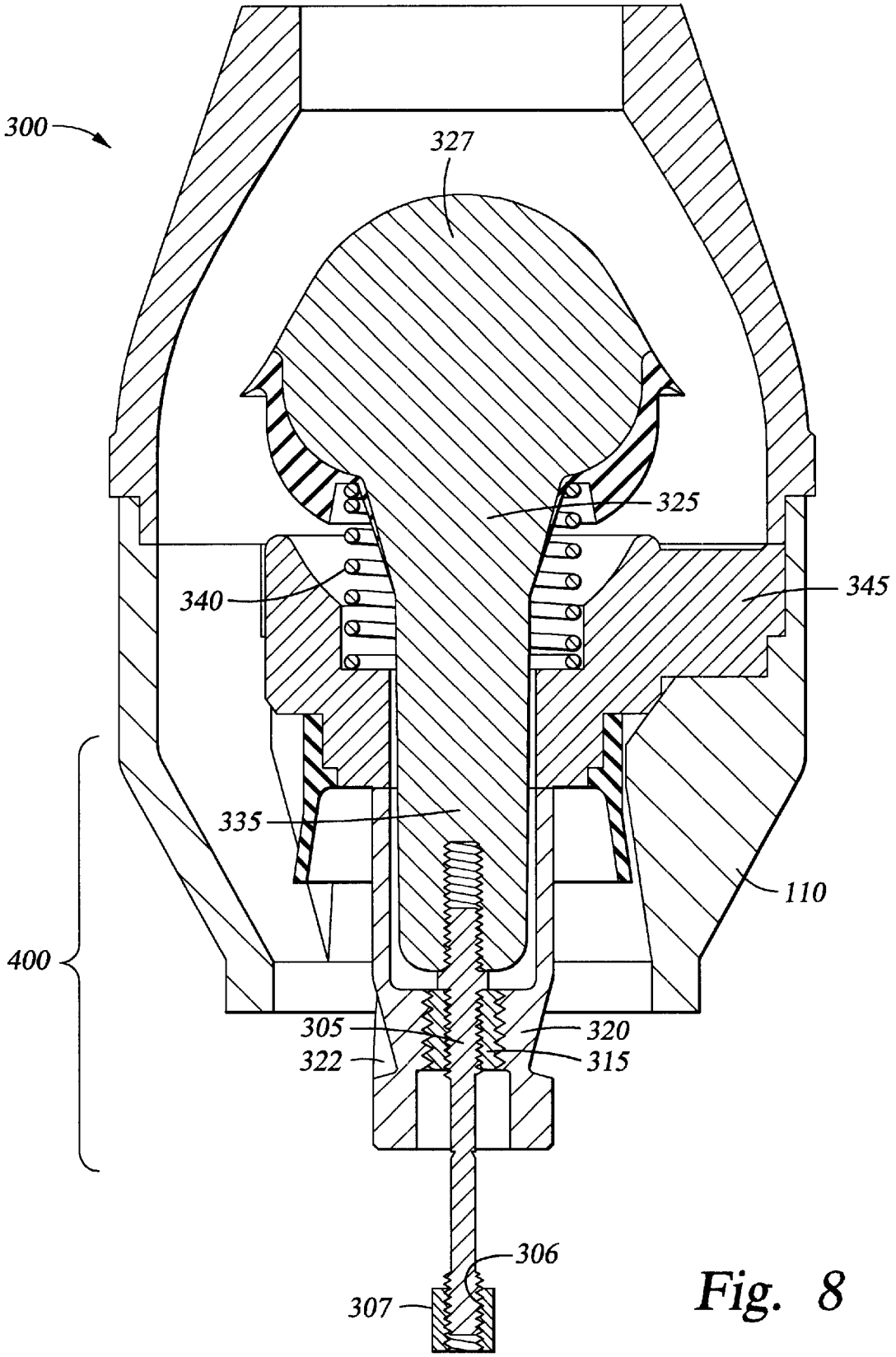
FIG. 8 is a section view showing an alternative embodiment of the valve with a retention assembly activated.

FIG. 8 is a section view illustrating an alternative embodiment of the invention. The valve 300 of FIG. 8, like the earlier embodiments includes a spring-loaded plunger 325 and an impeller 320 attached to the plunger by a threaded member. In the embodiment of FIG. 8, a bushing 315 is disposed in the interior of the impeller 320 and an interior of the plunger shaft 335 is threaded. A partially threaded bolt 305 is threaded into the plunger shaft at an upper end and is also threaded through the bushing 315. FIG. 8 illustrates the valve 300 in an initial position in which a head 327 of the plunger 325 is biased against spring member 340 thereby opening the valve to flow therethrough. The bolt 305 also includes a lower end having additional threads 306 formed thereupon and a nut 307 retained on the threads.

In operation, the valve 300 of FIG. 8 operates as follows: During run-in of a string of tubulars into the wellbore the valve permits the tubular string to fill with fluid. Thereafter, the retention assembly 400 made up of the impeller 320 and bolt 305 is caused to deactivate by the flow of fluid on the plunger head 327 at a specific rate and for a predetermined amount of time. As with the earlier embodiment, the flow of fluid causes the plunger head 327 to move downwards against the spring 340 and permits the impeller 320 to move out of engagement with a support member 145. With the impeller out of engagement, blades 322 formed on the impeller cause it to rotate in a counterclockwise direction and the bushing 315 and impeller 320 rotate and move axially away from the plunger shaft 335. As the rotating threads of the bushing 315 reach a portion of the bolt which is unthreaded, the bushing and impeller drop to a second position in relation to the bolt 305. As the impeller continues to rotate in a counterclockwise direction it becomes threadedly attached to the threads 306 at the lower portion of the bolt 305 and is prevented from additional rotation. The threaded portion at the lower end of the threaded member is designed to prevent the impeller from rotating after the retention assembly 400 is deactivated in order to prevent any damage that might come about due to the freely rotating impeller.

Figure 9:
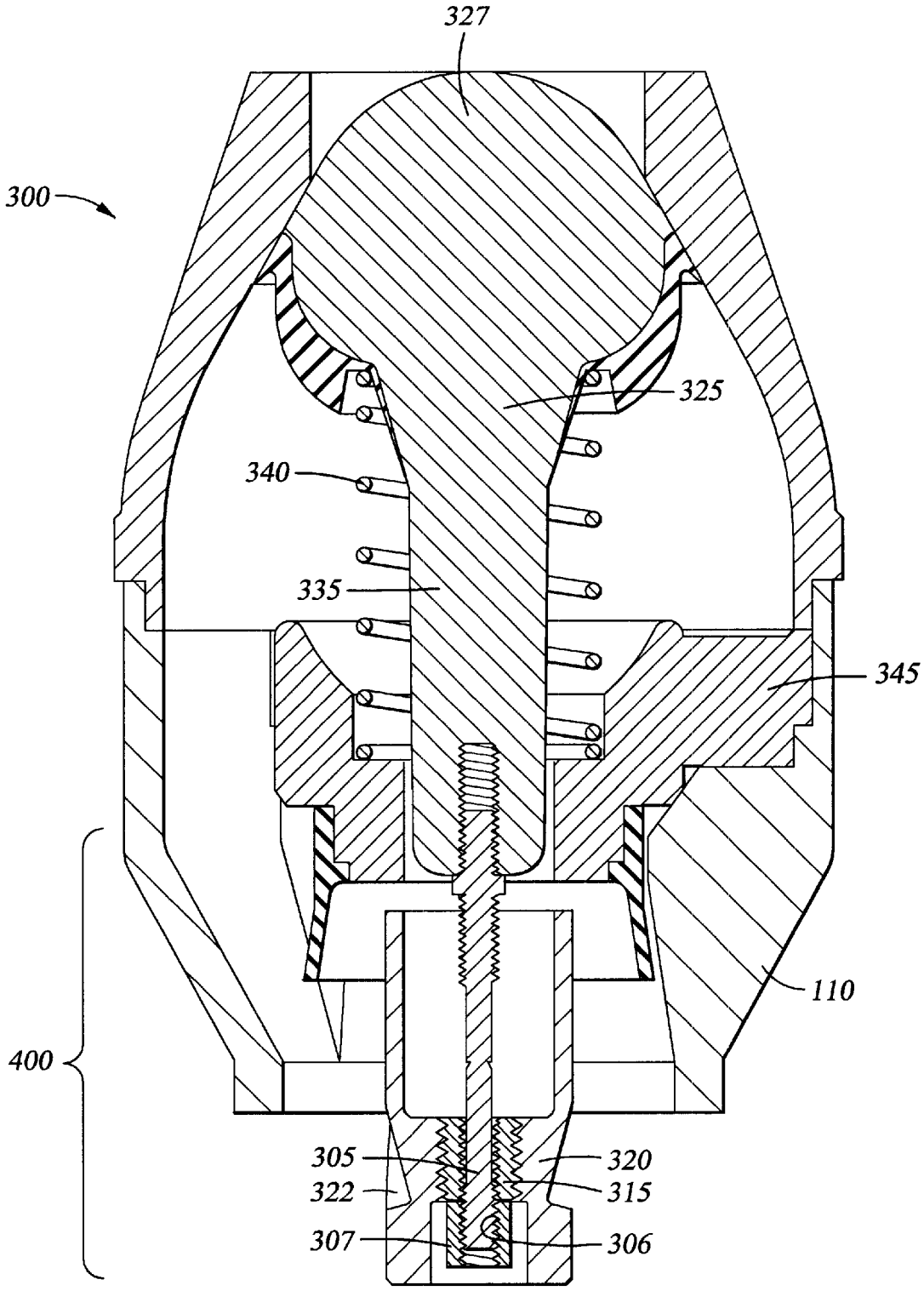
FIG. 9 is a section view of the valve of FIG. 8 with the retention assembly deactivated.

FIG. 9 is a section view of the valve 300 illustrating the components of the valve 300 after the retention assembly 400 has been deactivated. The plunger 325 is in its normally closed, spring biased position and the impeller 320 is threaded at a lower end of the bolt 305, thereby preventing additional rotation of the impeller 320.

While the valve of the present invention has been described with the use of an impeller which is rotated by the flow of fluid, it will be understood that the invention could use any type of rotatable member to deactivate the retention assembly and the invention is not limited to the use of an impeller having blades to be acted upon by a passing fluid flow. For instance, the rotatable member could be rotated by a downhole motor, a spring or anything else to translate the rotatable member along the threads of another member to deactivate a retention assembly. These variations are fully within the scope of the invention.

While the foregoing is directed to embodiments of the present invention, other and further embodiments of the invention may be devised without departing from the basic scope thereof, and the scope thereof is determined by the claims that follow. For example, the retention assembly 200 could be used with various valve devices including flapper valves and the invention is not limited to use with plunger-type valves.

What is claimed is:

1. A flow-actuated valve for use in a wellbore comprising:

a body;

a closing member and seat within the body, the closing member and seat separable to open and close the valve to the flow of fluid therethrough;

a retainer to initially retain the valve in the open position absent a predetermined fluid flow rate in a first direction for a predetermined time period, wherein the retainer includes a rotatable member, the member rotatable in a first direction by the predetermined flow rate flowing along its body; and a biasing member thereafter urging the valve to the closed position absent a subsequent flow of fluid in the first direction.

2. The valve of claim 1, wherein the rotatable member is an impeller and is threadedly connected to the closing member and is axially movable with respect thereto.

3. The valve of claim 2, wherein axial movement is brought about by rotation of the impeller in the first direction.

4. The valve of claim 3, wherein the biasing member is a spring and the closing member is a plunger.

5. The valve of claim 4, wherein the axial movement results in a deactivation of the retainer.

6. The valve of claim 5, wherein the threaded connection is a threaded bolt and a threaded bushing, the bushing disposable in a shaft of the plunger.

7. The valve of claim 5, wherein the threaded connection is a threaded bolt and a threaded bushing, the bushing disposable in the impeller and the threaded bolt disposable in the shaft of the plunger.

8. The valve of claim 1, wherein the valve is disposable in a tubular in a manner wherein substantially all fluid passing through the tubular must pass through the valve.

9. A plunger valve for use in a wellbore, the plunger valve comprising:

a housing with a valve seat formed therein;

a plunger biased into contact with the seat;

a retention assembly for retaining the valve in an open position; and a release mechanism for releasing the retention assembly, the release mechanism comprising a rotatable member.

10. A method of disposing a tubular in a wellbore, comprising:

running the tubular into the wellbore, the tubular including a valve having a housing, a valve seat, a closing member for contact with the valve seat, a biasing member biasing the plunger into contact with the valve seat, and a retention assembly constructed and arranged to initially retain the valve in an open position against the biasing member, wherein the retainer includes a rotatable member, the member rotatable in a first direction by the predetermined flow rate flowing along its body;

permitting the tubular to fill with wellbore fluid during run-in;

deactivating the retention assembly with a predetermined fluid flow rate for a predetermined period of time; and pumping a zonal isolation fluid through the tubular into an annular area defined between the outside of the tubular and a wall of the wellbore.

11. A valve for use in a wellbore comprising:

a body;

a closing member within the body, the closing member positionable in a first position and a second position;

a retainer operatively connected to the closing member for retaining the closing member in the first position, wherein actuation of the retainer allows the closing member to move to the second position; and a delay member for delaying the actuation of the retainer until an actuation event has occurred for a predetermined period of time.

12. A flow-actuated valve for use in a wellbore, comprising:

a body;

a closing member and seat within the body, the closing member and seat separable to open and close the valve to the flow of fluid therethrough;

a retainer to initially retain the valve in the open position absent a predeterminable fluid flow rate in a first direction to move the closing member to a second position and thereafter, a lower flow rate to operate a delay mechanism prior to closing the valve.

13. Running a flow actuated valve into a wellbore, the valve including a closing member temporarily held in a first, open position;

causing the valve to close by:

flowing fluid to depress the closing member to a second open position and thereafter;

flowing fluid for a predetermined amount of time to operate a flow actuated delay mechanism.

* * * * *